United States Patent [19]

Cho

[11] Patent Number: 4,795,502

[45] Date of Patent: Jan. 3, 1989

[54] ALUMINUM-LITHIUM ALLOY PRODUCTS AND METHOD OF MAKING THE SAME

[75] Inventor: Chul W. Cho, Monroeville, Pa.

[73] Assignee: Aluminum Company of America, Pittsburgh, Pa.

[21] Appl. No.: 37,776

[22] Filed: Apr. 13, 1987

Related U.S. Application Data

[63] Continuation-in-part of Ser. No. 927,054, Nov. 4, 1986, which is a continuation-in-part of Ser. No. 793,260, Oct. 31, 1985.

[51] Int. Cl.[4] ..... C22F 1/04

[52] U.S. Cl. ..... 148/2; 148/12.7 A; 148/417; 148/439

[58] Field of Search ..... 148/2, 11.5 A, 12.7 A, 148/417, 439

[56] References Cited

U.S. PATENT DOCUMENTS

| | | | |
|---|---|---|---|
| 1,620,081 | 3/1927 | Czochralski et al. | 420/528 |
| 1,620,082 | 3/1927 | Czochralski | 420/531 |
| 2,381,219 | 8/1945 | LeBaron | 75/139 |
| 2,915,390 | 12/1959 | Criner | 75/141 |
| 2,915,391 | 12/1959 | Criner | 75/142 |
| 4,094,705 | 6/1978 | Sperry et al. | 148/2 |
| 4,409,038 | 10/1983 | Weber | 148/12.7 A |

FOREIGN PATENT DOCUMENTS

| | | |
|---|---|---|
| 90583 | 5/1983 | European Pat. Off. . |
| 1927500 | 2/1971 | Fed. Rep. of Germany . |
| 1148719 | 6/1957 | France . |
| 3401391 | 4/1984 | PCT Int'l Appl. . |
| 8502416 | 6/1985 | PCT Int'l Appl. . |
| 707373 | 10/1974 | U.S.S.R. . |
| 1172735 | 12/1969 | United Kingdom . |
| 2115836 | 9/1983 | United Kingdom . |

OTHER PUBLICATIONS

"Advanced Aluminum Metallic Materials and Processes for Application to Naval Aircraft Structures" by W. T. Highberger et al., 12th National SAMPE Technical Conference, Oct. 7-9, 1980.

"Alloying Additions and Property Modification in Al-Li-X Systems" by F. W. Gayle, Int'l. Al-Li Conference, Stone Mountain, GA, May 19-21, 1980.

"Heat Treatment, Microstructure and Mechanical Property Correlations in A l-Li-Cu and Al-Li-Mg P/M Alloys" by G. Chanani et al, Society/AIME, Dallas, TX Feb. 17-18, 1982.

"Age Hardening Behavior of Al-Li-(Cu)-(Mg)-Zr P/M Alloys" by D. J. Chellman et al., Proceedings of 1982 Nat'l. Conf. P/M Products and Properties Session, Montreal, Canada, May 1982.

"Precipitation in Al-Li-Cu Alloys" by J. E. O'Neal et al., 39th Annual EMSA Meeting, Atlanta, GA, Aug. 10-14, 1981.

"HVEM In Situ Deformation of Al-Li-X Alloys" by R. E. Crooks et al, Scripta METALLURGICA, vol. 17, pp. 643-647, 1983.

(List continued on next page.)

*Primary Examiner*—R. Dean

*Attorney, Agent, or Firm*—Andrew Alexander

[57] ABSTRACT

A method of producing an unrecrystallized wrought aluminum-lithium sheet product having improved levels of strength and fracture toughness is disclosed. The method comprises providing a body of a lithium containing aluminum base alloy comprised of 1.5 to 2.5 wt. % Li, 1.6 to 2.8 wt. % Cu, 0.7 to 2.5 wt. % Mg, 0.03 to 0.20 wt. % Zr, 0.5 wt. % max. Fe, 5 wt. % max. Si, the balance essentially aluminum and incidental elements and impurities. The body is heated to a hot working temperature, hot worked to produce a first product, then reheated while avoiding substantial recrystallization thereof, the reheating adapted to relieve stored energy capable of causing recrystallization during a subsequent heat treating step. The reheated product is solution heat treated, quenched and aged to provide a substantially unrecrystallized sheet product having improved levels of strength and fracture toughness.

33 Claims, 10 Drawing Sheets

ELONGATION VS. TENSILE YIELD STRESS IN LONGITUDINAL DIRECTION

OTHER PUBLICATIONS

"Developments in Structures and Manufacturing Techniques" by C. J. Peel et al, Aeronautical Journal, Sep. 1981.

"Aluminum-Lithium Alloys: New Materials for Tomorrow's Technology" by T. H. Sanders, Jr. et al, Foote Prints, vol. 44, No. 1, 1981.

"The Mechanical Properties of Aluminum-Lithium Alloy" by M. Y. Drtis et al, Splavy Tsvetnykh Metalloy, 1972, pp. 187-192.

"Factors Influencing Fracture Toughness and Other Properties of Aluminum-Lithium Alloys" by T. H. Sanders et al, Naval Air Dev. Center Contract No. N62269-76-C-0271 for Naval Air Systems Command. Lockheed Report No. LM C-D766966 Sep. 1980, p. 10.

"Effect of Composition and Heat Treatment on Strength and Fracture Characteristics of Al-Li-Mg Alloys" by S. J. Harris, B. Noble and K. Dinsdale, Pub. 1984 Feb. according to information from AIME.

R-CURVE TOUGHNESS VS. YIELD STRENGTH

R-CURVE TOUGHNESS VS. YIELD STRENGTH

EFFECT OF STRETCH ON TEAR/YIELD RATIO

EFFECT OF STRETCH ON TEAR/YIELD RATIO

EFFECT OF STRETCH ON LONG-TRANSVERSE TOUGHNESS

TEAR STRENGTH - YIELD STRENGTH RATIO VS YIELD STRENGTH FOR 2024

ELONGATION VS. TENSILE YIELD STRESS IN LONGITUDINAL DIRECTION

TS / TYS VS. TYS IN LONGITUDINAL DIRECTION

——— 200 MICRONS

AL2090 COLD ROLLED SHEET 0.080 INCH GAUGE

AS SOLUTION HEAT TREATED

RECRYSTALLIED COARSE GRAINS

200 MICRONS

AL2090 COLD ROLLED SHEET
0.080 INCH GAUGE
AS SOLUTION HEAT TREATED
UNRECRYSTALLIZED STRUCTURE

200 MICRON

S.NO.585703-1 UNRECRYSTALLIZED

200 MICRON

S.NO.585703-2 RECRYSTALLIZED

S.No.575425-AB
0.100" gauge 2091 sheet
Recrystallized Structure
Surface to T/2
Magnification; 50X
Electro Etched S.No.575418
0.100" gauge 2091 sheet
Unrecrystallized Structure
Surface to T/2
Magnification; 50X
Electro Etched

16" X 44" PANEL TEST IN L-T DIRECTION
RECRYSTALLIZED VS. UNRECRYSTALLIZED SHEET

ALUMINUM-LITHIUM ALLOY PRODUCTS AND METHOD OF MAKING THE SAME

CROSS REFERENCE TO RELATED APPLICATION

This application is a continuation-in-part of U.S. Ser. No. 927,054, filed Nov. 4, 1986, which is a continuation-in-part of U.S. Ser. No. 793,260, filed Oct. 31, 1985.

BACKGROUND OF THE INVENTION

This invention relates to aluminum base alloy products, and more particularly, it relates to improved lithium containing aluminum base alloy products and a method of producing the same.

In the aircraft industry, it has been generally recognized that one of the most effectvve ways to reduce the weight of an aircraft is to rdduce the density of aluminum alloys usedin the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

With respect to conventional alloys, both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, intthe same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

The present invention solves problems which limited the use of these alloys and provides an improved lithium containing aluminum base alloy product which can be processed to provide improved strength characteristics while retaining high toughness properties.

SUMMARY OF THE INVENTION

An object of this invention is to provide an unrecrystallized, thin gauge plate or unrecrystallized sheet gauge aluminum lithium alloy, including cladded sheet and thermomechanical processing practice, which greatly improves strength and fracture toughness properties of such alloy.

A principal object of this invention is to provide an improved lithium containing aluminum base alloy product.

Another object of this invention is to provide an improved aluminum-lithium alloy wrought product having improved strength and toughness characteristics.

Yet anoter object of this invention is to provide an aluminum-lithium alloy product capable of being worked after solution heat treating to improve strength properties without substantially impairing its fracture toughness.

And yet another object of this invention includes a method of providing a wrought aluminum-lithium alloy product and working the product after solution heat treating to increase strength properties without substantially impairing its fracture toughness.

And yet a further object of this invention is to provide a method of increasing the strength of a wrought aluminum-lithium alloy product after solution heat treating without substantially decreasing fracture toughness.

These and other objects will become apparent from the specification, drawings and claims appended hereto.

In accordance with these objects, a method of producing an unrecrystallized wrought aluminum-lithium sheet product having improved levels of strength and fracture toughness is disclosed. The method comprises the steps of: providing a body of a lithium containing aluminum base alloy comprised of 1.5 to 2.5 wt. % Li, 1.6 to 2.8 wt. % Cu, 0.7 to 2.5 wt. % Mg, 0.03 to 0.20 wt. % Zr, 0.5 wt. % max. Fe, 5 wt. % max. Si, the balance essentially aluminum and incidental elements and impurities. The body is heated to a hot working temperature, hot worked to produce a first product, then reheated while avoiding substantial recrystallization thereof, the reheating adapted to relieve stordd energy capable of causing recrystallization during a subsequent heat treating step. The reheated product is solution heat treated, quenched and aged to provide a substantially unrecrystallized sheet product having improved levels of strength and fracture toughness.

DETAILED DESCRIPTION OF THE PREFERRED EMBODIMENTS

Figure 1:
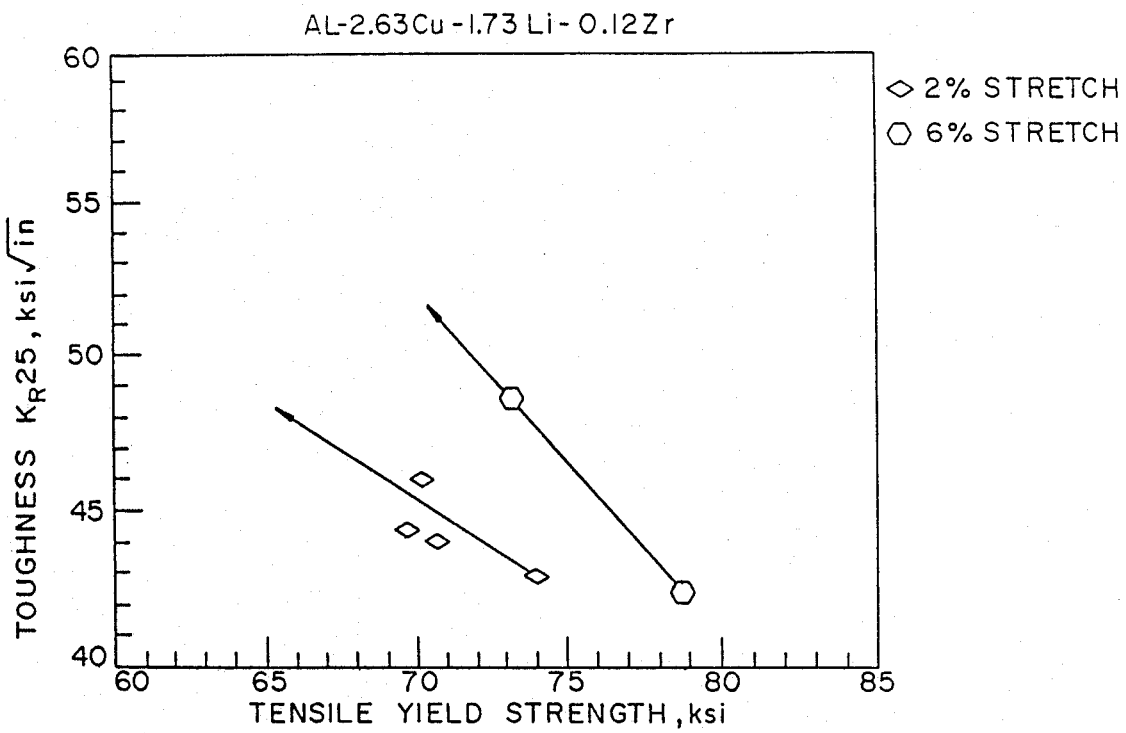
FIG. 1 shows that the relationship between toughness and yield strength for a worked alloy product is increased by stretching.

The alloy of the present invention can contain 0.5 to 4.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incddental impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

A preferred alloy in accordance with the present invention can contain 1.0 to 4.0 wt. % Li, 0.1 to 5.0 wt. % Cu, 0 to 5.0 wt. % Mg, 0 to 1.0 wt. % Zr, 0 to 2 wt. % M,, the balance aluminum and impurities as specified above. A typical alloy composition would contain 2.0 to 3.0 wt. % Li, 0.5 to 4.0 wt. % Cu, 0 to 3.0 wt. % Mg, 0 to 0.2 wt. % Zr, 0 to 1.0 wt. % Mn and max. 0.1 wt. % of each of Fe and Si.

As will be appreciated from the foregoing alloy compositions, the present invention includes Al-Li-Cu-Mg alloys such as AA2091 type Al-Li alloys. Such alloy composition can have 1.5 to 2.5 wt. % Li, 1.6 to 2.8 wt. % Cu, 0.7 to 2.5 wt. % Mg and 0.03 to 0.19 wt. % Zr, with a preferred composition being 1.7 to 2.3 wt. % Li, 1.8 to 2.5 wt. % Cu, 1.1 to 1.9 wt. % Mg and 0.04 to 0.16 wt. % Zr, the balance aluminum and impurities.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements. It is not presently expected that higher levels of lithium would improve the combination of toughness and strength of the alloy product.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries. Cr, Hf, Ti, V, Sc and Mn can also be used for grain structure control but on a less preferred basis. Zirconium is the preferred material for grain structure control.

Toughness or fracture toughness as used herein refers to the resistance of a body, e.g. sheet or plate, to the unstable growth of cracks or other flaws.

Figure 7:
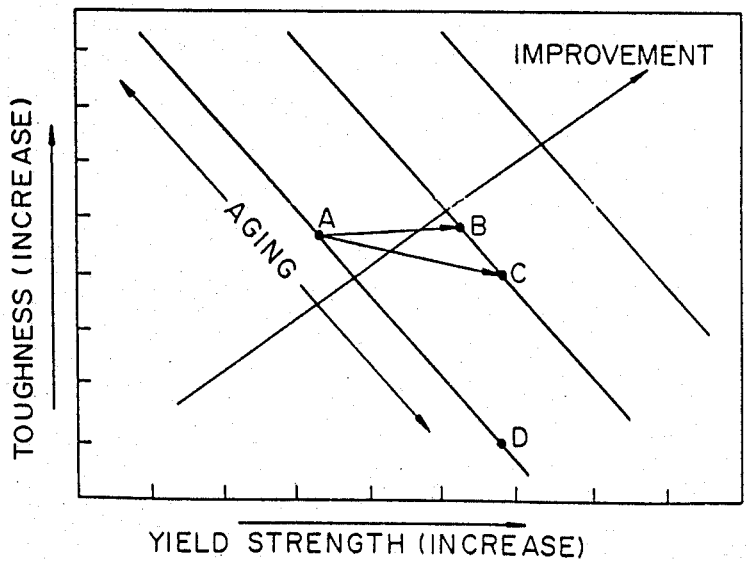
FIG. 7 illustrates different toughness yield strength relationships where shifts in the upward direction and to the right represent improved combinations of these properties.

Improved combinations of strength and toughness is a shift in the normal inverse relationship between strength and toughness towards higher toughness values at given levels of strength or towards higher strength values at given levels of toughness. For example, in FIG. 7, going from point A to point D represents the loss in toughness usually associated with increasing the strength of an alloy. In contrast, going from point A to point B results in an increase in strength at the same toughness level. Thus, point B is an improved combination of strength and toughness. Also, in going from point A to point C results in an increase in strength while toughness is decreased, but the combination of strength and toughness is improved relative to point A. However, relative to point D, at point C, toughness is improved and strength remains about the same, and the combination of strength and toughness is considered to be improved. Also, taking point B relative to point D, toughness is improved and strength has decreased yet the combination of strength and toughness are again considered to be improved.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control fmal grain structure.

After the homogenizing treatment, the metal can be rolled or extruded or otherwise subjected to working operations to produce stock such as sheet, plate or extrusions or other stock suitable for shaping into the end product.

If it is desired to produce an unrecrystallized product, the thermomechanical steps must be carefully controlled. By unrecrystallized is meant the absence of well-developed grains and the presence of a highly worked structure which may include therein continuously recrystallized microstructure still retaining as-worked texture. That is, after the ingot has been homogenized it may be hot worked or hot rolled. Hot rolling may be performed at a temperature in the range of 700° to 950° F. with a typical temperature being in the range of 775° to 950° F. For Al-Li-Cu-Mg alloys, e.g., AA 2091, the hot rolling temperature is preferably in the range of 800° to 925° F. for hot rolling, normally for producing thick slab. Hot rolling can reduce the thickness of the ingot to one-fourth of its original thickness or to final gauge, depending on the capability of the rolling equipment. Cold rolling may be used to provide further gauge reduction. Preferably, such cold rolling produces final gauge thickness.

To produce an unrecrystallized sheet product, the cold rolled product (normally rolled to final gauge) is subjected to a controlled reheat treatment. This treatment is carried out for a time and temperature at which recrystallization does not occur. The reheat treatment is provided to relieve stored energy capable of causing recrystallization during subsequent solution heat treatments.

A reheat treatment in accordance with the invention which results in an unrecrystallized product after solution heat treating can be achieved when cold rolled or worked product is subjected to a temperature of 800° F. for 12 hours. The time at temperatures for the reheat process is important. For example, the initial temperature for the reheat treatment should not be less than 750° F. and the highest temperature should not exceed 920° F. Preferably, the initial temperature is about 800° F. and the temperature increased gradually 50 to 100° F. above 800° F. until the maximum temperature is reached, sometimes referred to as a ramp anneal. The ramped anneal rate can range from 3° to 25° F. per hour from the low to the high temperature with a typical rate being about 6° F. per hour. For example, if reheat is for thin gauge sheet, the temperature should be raised above the effective starting temperature about 50° F. over a period of at least 2 to 8 hours. Thereafter, the sheet should be held at 850° F. for about 1 to 3 hours, typically 2 hours before being cooled to romm temperature. If the cooling rate in the furnace is controlled, this can improve the effectiveness of the process. The return to room temperature may be over a period of 6 to 10 hours, typically 8 hours, to guard against small amounts of recrystallization, particularly at low lithium levels. If the reheat treatment is applied to extrusions or forgings, then the temperature can be raised by as much as 150° F. from a starting reheat temperature of 750° F. The ramp anneal rate can be as low as 5° F. per hour and as high as 25° F. per hour with a typical rate being 10° to 15° F. per hour. However at the higher rates, there is a greater likelihood of some or partial recrystallization after solution heat treating. When the extrusion or forgings have reached 900° F., then they may be held at that temperature for 1 to 4 hours to ensure relief of stored energy but not long enough to cause recrystallization. Thereafter the temperature may be lowered at a controlled rate to room temperature. Products such as rivet wire or plate (AA2090) can be reheated in the same manner except the time for reheat, starting at a reheat temperature of 750° to 800° F., should be 12 hours for rivet wire to reach 900° F. and 24 houss for AA2090 plate to reach 900° F., for example. The longer times or slower ramp anneal rates are required for products having lower amounts of elements which resist recrystallization, e.g., Zr. By ramped anneal is meant to include gradual and stepped increases in temperature.

If the first hot rolling step is to an intermediate product, e.g., slab 1 to 5 inches thick, then the slab should be heated to a temperature in the range of 650° to 850° F., preferably 700° to 800° F. for a period of 0.5 to 20 huurs. This material is hot rolled beginning at a temperature in the range of 650° to 850° F. to further reduce the thickness of the slab, e.g., to 0.1 to 0.3 inch. Prior to cold rolling, the 0.1 to 0.3 inch material may be subject to a softening anneal at a temperature in the range of 500° to 850° F. for 2 to 8 hours, for example, and then cold rolled. After subjecting the cold rolled material to the ramped anneal, the sheet product is solution heat treated typically at a temperature in the range of 960° to 1040° F. for a period in the range of 0.25 to 5 hours. It should be understood that this material may be provided with a cladding for purposes of enhancing appearance and corrosion resistance. Typically, cladding alloys include the AA1100 and AA1200 type alloys and AA7072 alloy.

To further provide for the desired strength and fracture toughness necessary to the final product and to the operations in forming that product, the product should be rapidly quenched to prevent or minimize uncontrolled precipitation of strengthening phases referred to herein later. Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled. When the alloy of the invention is slab cast or roll cast, for example, it may be possible to omit some or all of the steps referred to hereinaboee, and such is contemplated within the purview of the invention.

Figure 5:
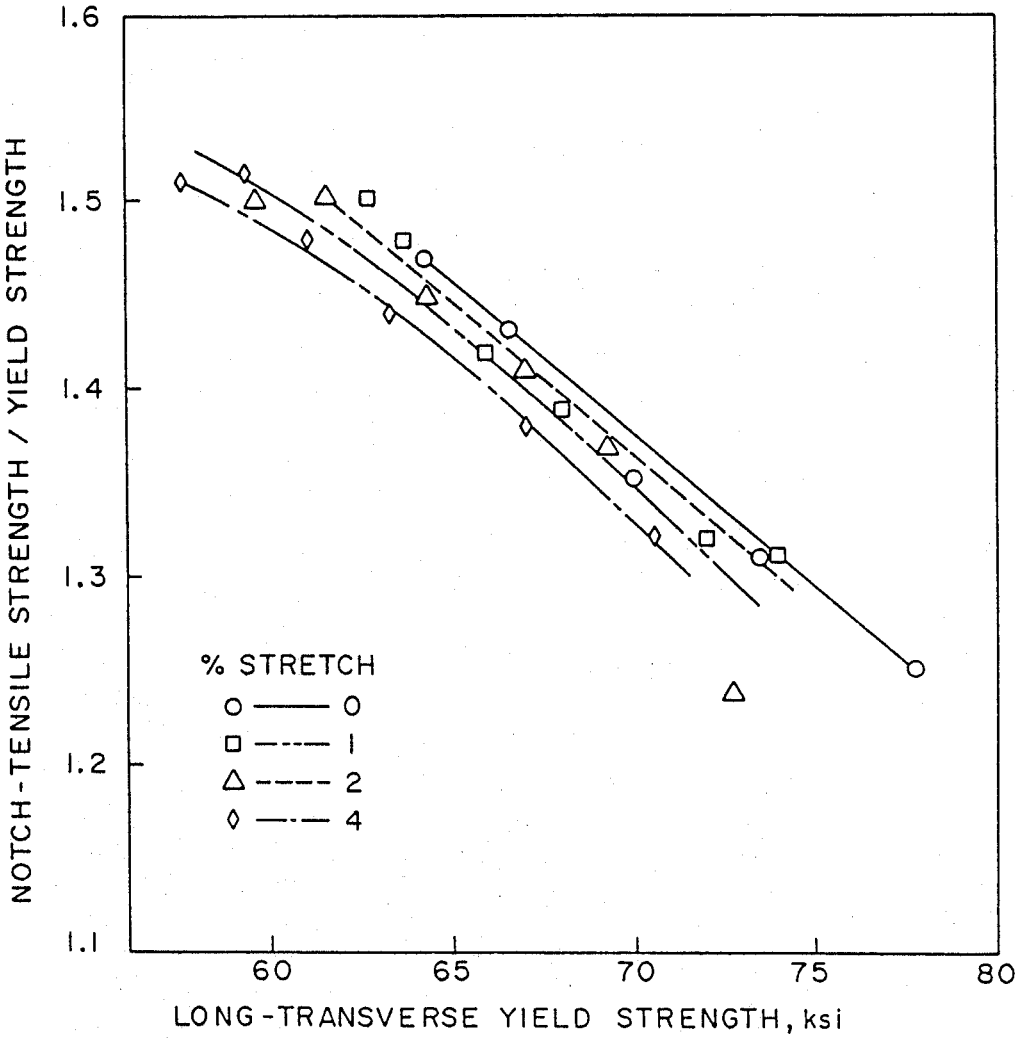
FIG. 5 shows that the relationship between toughness (notch-tensile strength divided by yield strength) and yield strength decreases with increase amounts of stretching for FIG. 6 shows that stretching AA2024 beyond 2% does not significantly increase the toughness-strength relationship for this alloy.
Figure 6:
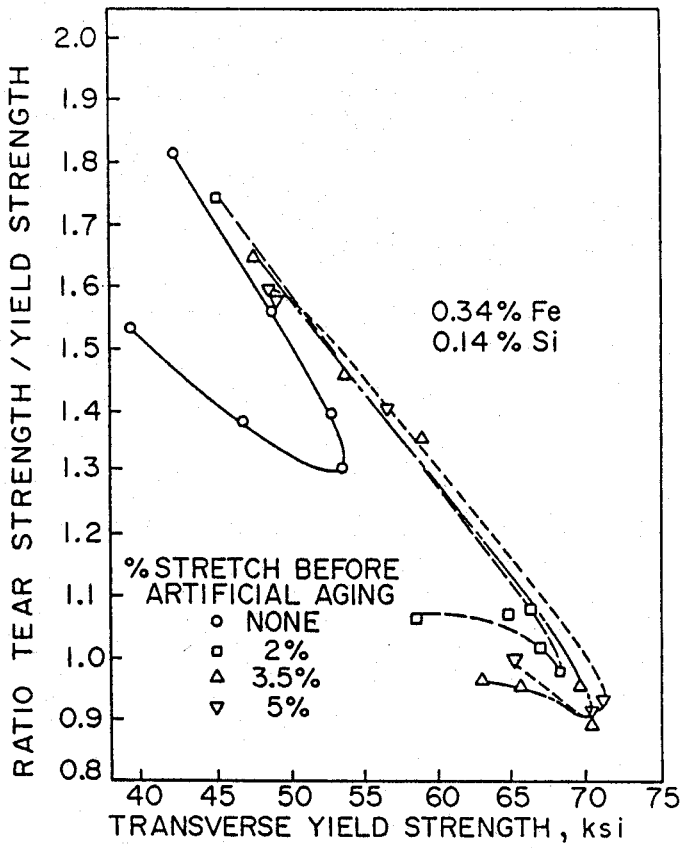

After solution heat treatment and quenching as noted herein, the improved sheet, plate or extrusion and other wrought products can hvve a range of yield strength from about 25 to 50 ksi and a level of fracture toughness in the range of about 50 to 150 ksi in. However, with the use of artificial aging to improve strength, fracture toughness can drop considerably. To minimize the loss in fracture toughness associated in the past with improvement in strength, it has been discovered that the solution heat treated and quenched alloy product, particularly sheet, plate or extrusion, may be stretched, preferably at room temperature, an amount greater than 3% of its original length or otherwise worked or deformed to impart to the product a working effect equivalent to stretching greater than 3% of its original length. The working effect referred to is meant to include rolling and forging as well as other working operations. It has been discovrred that the strength of sheet or plate, for example of the subject alloy can be increased substantially by stretching prior to artificial aging, and such stretching causes little or noddecrease in fracture toughness. It will be appreciated that in comparable high strength alloys, stretching can produce significant drop in fracture toughness. Stretching AA7050 reduces both toughness and strength, as shown in FIG. 5, taken from the reference by J. T. Staley, mentioned previously. Similar toughness-strength data for AA2024 are shown in FIG. 6. For AA2024, stretching 2% increases the combination of toughness and strength over that obtained without stretching: however, further stretching does not provide any substantial increases in toughness. Therefore, when considering the toughness-strength relationship, it is of little benefit to stretch AA2024 more than 2%, and it is detrimental to stretch AA7050. In contrast, when stretching or its equivalent is combined with artificial aging, an alloy product in accordance with the present invention can be obtained having significantly increased combinations of fracture toughness and strength.

While the inventors do not necessarily wish to be bound by any theory of invention, it is believed that defommation or working, such as stretching, applied after solution heat treating and quenching, results in a more uniform distribution of lithium-containing metastable precipitates after artificial aging. These metastable precipitates are believed to occur as a result of the introduction of a high density of defects (dislocations, vacancies, vacancy clusters, etc.) which can act as preferential nucleation sites for these precipitating phases (such as $T_1'$ a precursor of the $Al_2CuLi$ phase) throughout each grain. Additionally, it is believed that this practice inhibits nucleation of both metastable and equilibrium phases such as $Al_3Li$, AlLi, $Al_2CuLi$ and $Al_5CuLi_3$ at grain and sub-grain boundaries. Also, it is believed that the combination of enhanced uniform precipitation throughout each grain and decreased grain boundary precipitation results in the observed higher combination of strength and fracture toughness in aluminum-lithium alloys worked or deformed as by stretching, for example, prior to final aging.

In the case of sheet or plate, for example, it is preferred that stretching or equivalent working is greater than 3% and less than 14%. Further, it is preferred that stretching be in the range of about a 4 to 12% increase over the original length with typical increases being in the range of 5 to 8%.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 95 ksi. However, the useful strengths are in the range of 50 to 85 ksi and corresponding fracture toughnesses are in the range of 25 to 75 ksi in. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging. However, it is presently believed that natural aging provides the least benefit. Also, while reference has been made herein to single aging steps, multiple aging steps, such as two or three aging steps, are contemplated and stretching or its equivalent working may be used prior to or even after part of such multiple aging steps.

The following examples are further illustrative of the invention.

EXAMPLE I

An aluminum alloy consisting of 1.73 wt. % Li, 2.63 wt. % Cu, 0.12 wt. % Zr, the balance essentially aluminum and impurities, was cast into an ingot suitable for rolling. The ingot was homogenized in a furnace at a temperature of 1000° F. for 24 hours and then hot rolled into a plate product about one inch thick. The plate was then solution heat treated in a heat treating furnace at a temperature of 1025° F. for one hour and then quenched by immersion in 70° F. water, the temperature of the plate immediately before immersion being 1025° F. Thereafter, a sample of the plate was stretched 2% greater than its original length, and a second sample was stretched 6% greater than its original length, both at about room temperature. For purposes of artificially aging, the stretched samples were treated at either 325° F. or 375° F. for times as shown in Table I. The yield strength values for the samples referred to are based on specimens taken in the longitudinal direction, the direction parallel to the direction of rolling. Toughness was determined by ASTM Standard Practice E561-81 for R-curve determination. The results of these tests are set forth in Table I. In addition, the results are shown in FIG. 1 where toughness is plotted against yield strength. It wlll be noted from FIG. 1 that 6% stretch displaces the strength-toughness relationship upwards and to the right relative to the 2% stretch. Thus, it will be seen that stretching beyond 2% substantially improved toughness and strength in this lithium containing alloy. In contrast, stetching decreases both strength and toughness in the long transverse direction for alloy 7050 (FIG. 5). Also, in FIG. 6, stretching beyond 2% provides added little benefit to the toughness-strength relationship in AA2024.

TABLE I

| Aging hrs. | Practice °F. | 2% Stretch Tensile Yield Strength, ksi | 2% Stretch $K_R25$, ksi in. | 6% Stretch Tensile Yield Strength, ksi | 6% Stretch $K_R25$, ksi in. |
|---|---|---|---|---|---|
| 16 | 325 | 70.2 | 46.1 | 78.8 | 42.5 |
| 72 | 325 | 74.0 | 43.1 | — | — |
| 4 | 375 | 69.6 | 44.5 | 73.2 | 48.7 |
| 16 | 375 | 70.7 | 44.1 | — | — |

EXAMPLE II

Figure 2:
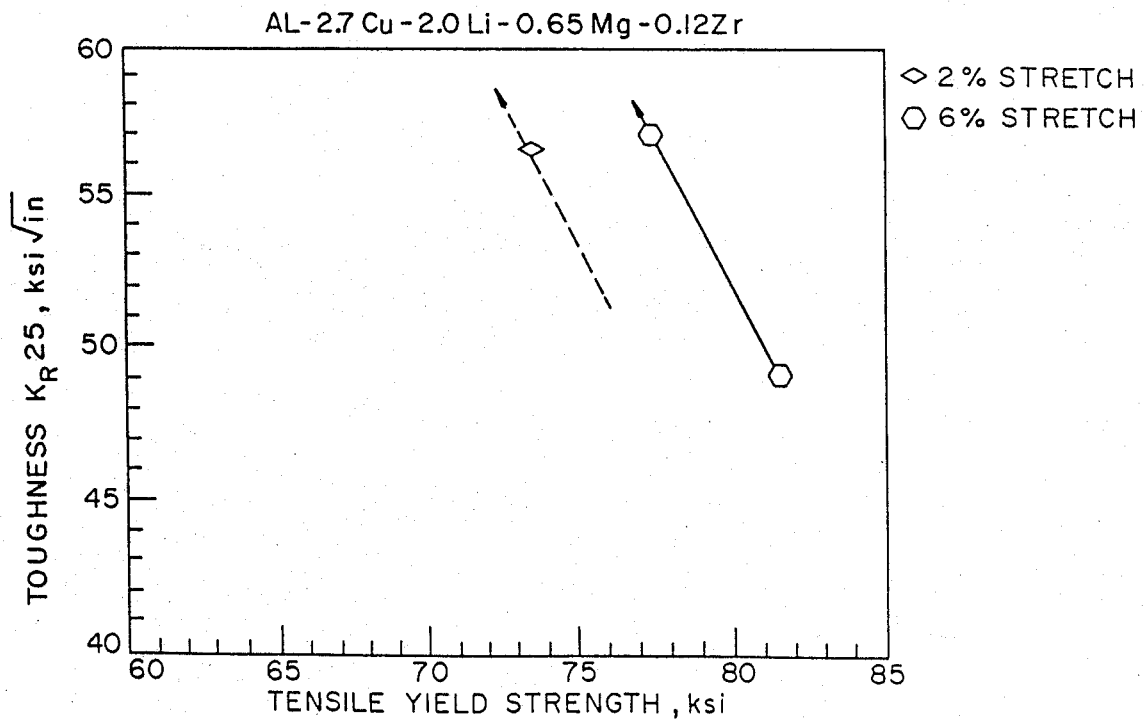
FIG. 2 shows that the relationship between toughness and yield strength is increased for a second worked alloy upon stretching.
Figure 3:
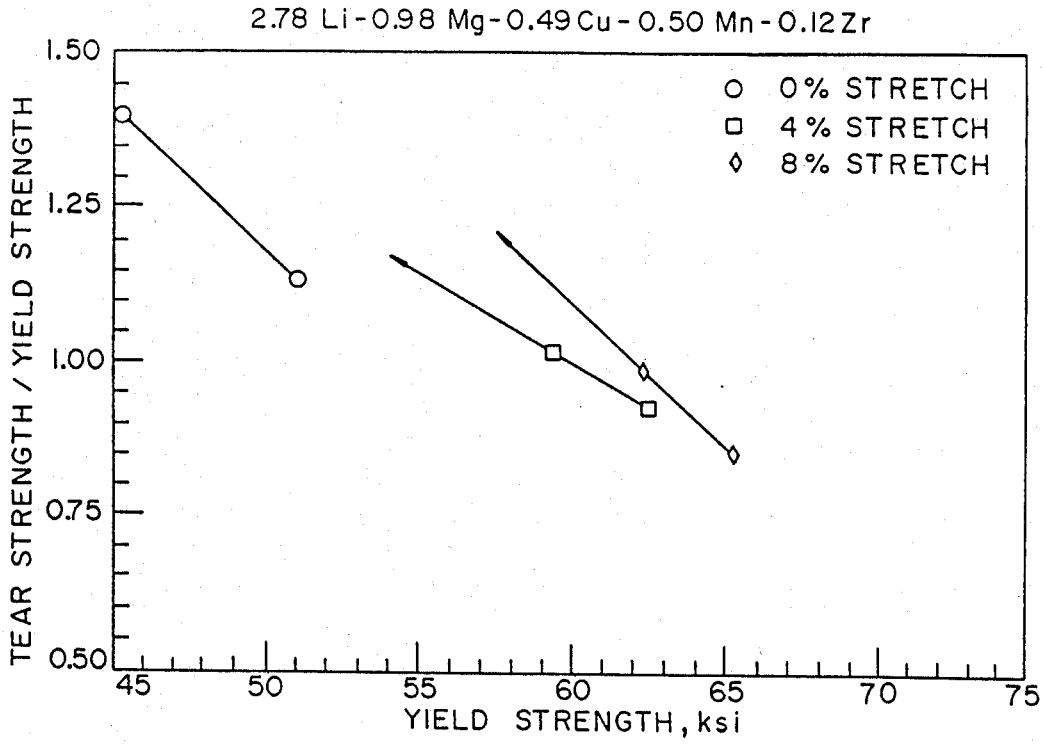
FIG. 3 shows the relatioship between toughness and yield strength of a third alloy product after stretching.

An aluminum alloy consisting of, by weight, 2.0% Li, 2.7% Cu, 0.65% Mg and 0.12% Zr, the balance essentially aluminum and impurities, was cast into an ingot suitable for rolling. The ingot was homogenized at 980° F. for 36 hours, hot rolled to 1.0 inch plate as in Example I, and solution heat treated for one hour at 980° F. Additionally, the specimens were also quenched, stretched, aged and tested for toughness and strength as in Example I. The results are provided in Table II, and the relationship between toughness and yield strength is set forth in FIG. 2. As in Example I, stretching this alloy 6% displaces the toughness-strength relationship to substantially higher levels. The dashed line through the single data point for 2% stretch is meant to suggest the probable relationship for this amount of stretch.

TABLE II

| Aging hrs. | Practice °F. | 2% Stretch Tensile Yield Strength, ksi | 2% Stretch $K_R25$, ksi in. | 6% Stretch Tensile Yield Strength, ksi | 6% Stretch $K_R25$, ksi in. |
|---|---|---|---|---|---|
| 48 | 325 | — | — | 81.5 | 49.3 |
| 72 | 325 | 73.5 | 56.6 | — | — |
| 4 | 375 | — | — | 77.5 | 57.1 |

EXAMPLE III

An aluminum alloy consisting of, by weight, 2.78% Li, 0.49% Cu, 0.98% Mg, 0.50 Mn and 0.12% Zr, the balance essentially aluminum, was cast into an ingot suitable for rolling. The ingot was homogenized as in Example I and hot rolled to plate of 0.25 inch thick. Thereafter, the plate was solution heat treated for one hour at 1000° F. and quenched in 70° water. Samples of the quenched plate were stretched 0%, 4% and 8% before aging for 24 hours at 325° F. or 375° F. Yield strength was determined as in Example I and toughness was determined by Kahn type tear tests. This tsst procedure is described in a paper entitled "Tear Resistance of Auuminum Alloy Sheet as Determined from Kahn-Type Tear Tests", *Materials Research and Standards,* Vol. 4, No. 4, 1984 April, p. 181. The results are set forth in Table III, and the relationship between toughness and yield strength is plotted in FIG. 5.

Here, it can be seen that stretching 8% provides increased strength and toughness over that already gained by stretching 4%. In contrast, data for AA2024 stretched from 2% to 5% (FIG. 6) fall in a very narrow band, unlike the larger effect of stretching on the toughness-strength relationship seen in lithium-containing alloys.

TABLE III

| Stretch | Aging Practice hrs. | Aging Practice °F. | Tensile Yield Strength ksi | Tear Strength ksi | Tear Strength/Yield Strength |
|---|---|---|---|---|---|
| 0% | 24 | 325 | 45.6 | 63.7 | 1.40 |
| 4% | 24 | 325 | 59.5 | 60.5 | 1.02 |
| 8% | 24 | 325 | 62.5 | 61.6 | 0.98 |
| 0% | 24 | 375 | 51.2 | 58.0 | 1.13 |
| 4% | 24 | 375 | 62.6 | 58.0 | 0.93 |
| 8% | 24 | 375 | 65.3 | 55.7 | 0.85 |

EXAMPLE IV

Figure 4:
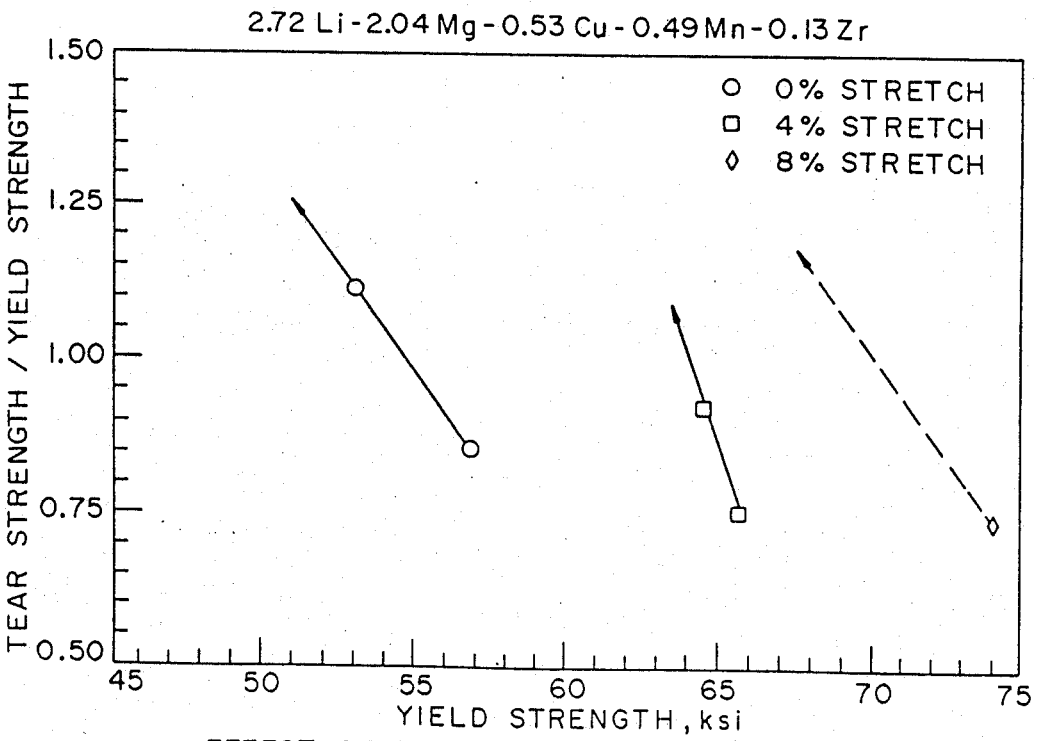
FIG. 4 shows that the relationship between toughness and yield strength is increased for another alloy product after stretching.

An aluminum alloy consisting of, by weight, 2.72% Li, 2.04% Mg, 0.53% Cu, 0.49 Mn and 0.13% Zr, the balance essentially aluminum and impurities, was cast into an ingot suitable for rolling. Thereafter, it was homogenized as in Example I and then hot rolled into plate 0.25 inch thick. After hot rolling, the plate was solution heat treated for one hour at 1000° F. and quenched in 70° water. Samples were taken at 0%, 4% and 8% stretch and aged as in Example I. Tests were performed as in Example III, and the results are presented in Table IV. FIG. 4 shows the relationship of toughness and yield strength for this alloy as a function of the amount of stretching. The dashed line is meant to suggest the toughness-strength relationship for this amount of stretch. For this alloy, the increase in strength at equivalent toughness is significantly greater than the previous alloys and was unexpected in view of the behavior of conventional alloys such as AA7050 and AA2024.

TABLE IV

| Stretch | Aging Practice hrs. | Aging Practice °F. | Tensile Yield Strength ksi | Tear Strength ksi | Tear Strength/Yield Strength |
|---|---|---|---|---|---|
| 0% | 24 | 325 | 53.2 | 59.1 | 1.11 |
| 4% | 24 | 325 | 64.6 | 59.4 | 0.92 |
| 8% | 24 | 325 | 74.0 | 54.2 | 0.73 |
| 0% | 24 | 375 | 56.9 | 48.4 | 0.85 |
| 4% | 24 | 375 | 65.7 | 49.2 | 0.75 |

EXAMPLE V

An aluminum alloy consisting of, by weight, 2.25% Li, 2.98% Cu, 0.12% Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 955° F. and hot rolled to 1.75 inch thick plate. The plate was solution heat treated for 2 hours at 1020° F. followed by a continuous water spray quench with a water temperature of 72° F. The plate was stretched at room temperature in the rolling direction with 4.9% permanent set. Stretching was followed by an artificial aging treatment of 18 hours at 325° F. Tensile properties were determined in the short transverse direction in accordance with ASTM B-557. These values are shown in Table V. The ultimate tensile strength and the yield tensile strength were equal, and the resulting elongations are zero.

TABLE V

| Specimen No. | Tensile Ultimate Strength (ksi) | Tensile Yield Strength (ksi) | Percent Elongation (%) |
|---|---|---|---|
| 1 | 51.5 | 51.5 | 0 |
| 2 | 47.3 | 47.3 | 0 |
| 3 | 55.0 | 55.0 | 0 |

EXAMPLE VI

Figure 8:
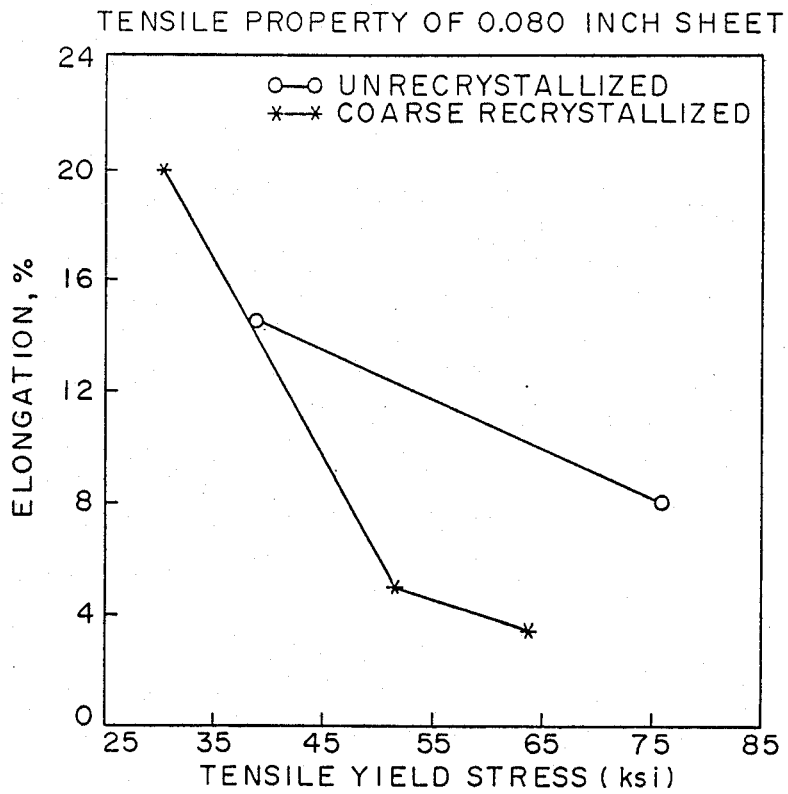
FIG. 8 shows a plot of elongation versus tensile yield stress of aluminum-lithium alloy processed in accordance with the invention and processed conventionally.
Figure 9:
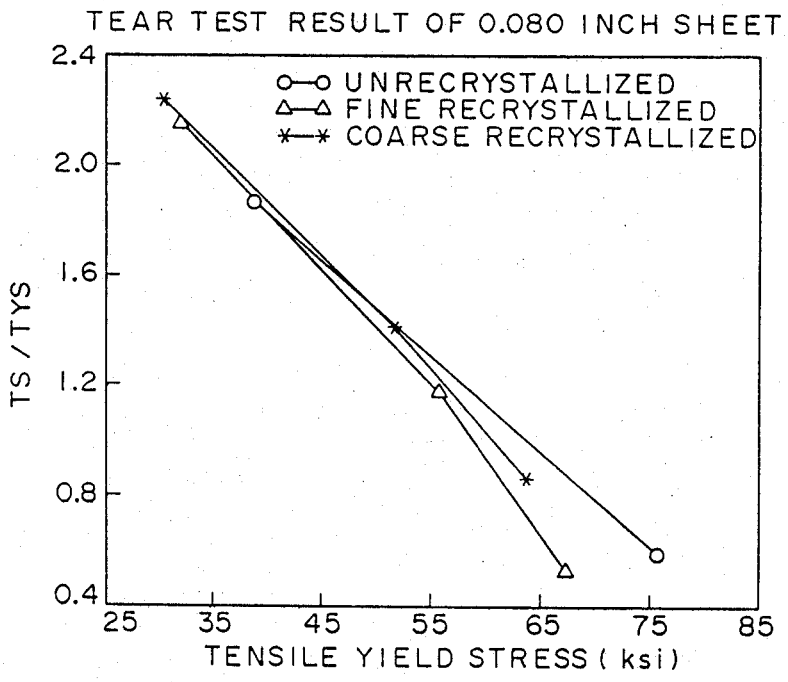
FIG. 9 shows tear test results of an aluminum-lithium alloy processed in accordance with the invention and processed conventionally.
Figure 10:
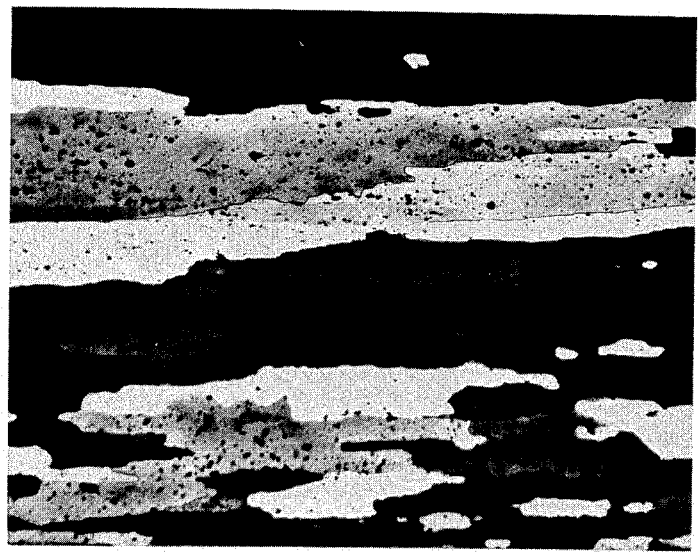
FIG. 10 shows a metallurgical structure of an aluminum-lithium alloy processed in accordance with conventional practices.

An aluminum alloy consisting of, by weight, 2.13% Li, 2.83% Cu, 0.13% Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 975° F. and hot rolled to 3.5" thick slab. The slab was reheated for 4 hours at 1000° F. and hot rolled to 0.144" thick sheet. The sheet was then annealed for 4 hours at 650° F. and cold rolled to 0.080" thick gauge sheet. The sheet was solution heat treated for 1 hour at 1000° F. followed by a cold water quench with a water temperature of 72° F. The sheet was stretched 4% at room temperature in the rolling direction. Stretching was followed by an artificial aging of 8 hours at 325° F. for under aged condition and 24 hours at 325° F. for peak aged condition. Examination of microstructure revealed heavily recrystallized microstructure with extremely coarse grain structures, as shown in FIG. 10. The tensile test result and tear test result are shown in FIGS. 8 and 9, shwwing properties at three strength levels, i.e., T3 temper (as stretched), underaged (stretched and aged for 8 hours at 325° F.) and peak aged (stretched and aged for 24 hours at 325° F.).

EXAMPLE VII

Figure 11:
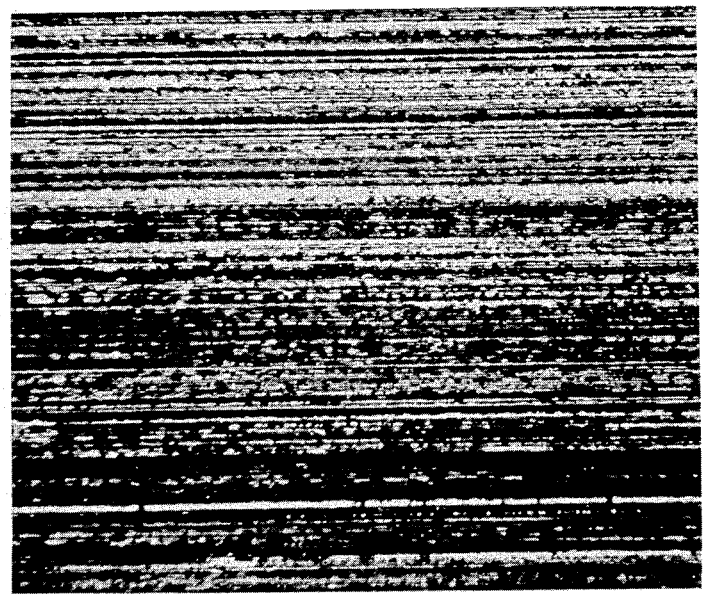
FIG. 11 shows an unrecrystallized metallurgical structure of an aluminum-lithium alloy processed in accordance with the invention.
Figure 12:
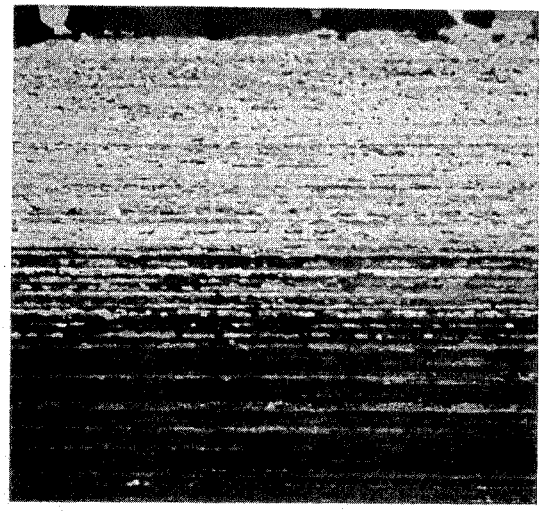
FIG. 12 shows a recrystallized metal structure of an aluminum-lithium alloy.

An aluminum alloy consisting of, by weight, 2.13% Li, 2.83% Cu, 0.13% Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 975° F. and hot rolled to 3.5" thick slab. The slab was reheated for 4 hours at 1000° F. and hot rolled to 0.144" thick sheet. The sheet was then annealed for 4 hours at 650° F. and cold rolled to 0.080" thick gauge sheet. The cold rolled sheet was annealed for 12 hours at 800° F. to relieve a stored energy capable of commencing recrystallization during the subsequent heat treatment. After the anneal step, the sheet was solution heat treated for 1 hour at 1010° F. followed by a cold water quench with a water temperature of 72° F. The sheet was stretched by 4% at room temperature in the rolling direction. Stretching was followed by an artificial aging of 8 hours at 325° F. for under aged condition and 24 hours at 325° F. for peak aged condition. Examination of microstructure revealed an unrecrystallized microstrutture, as shown in FIG. 11. The tensile test result and tear test result are shown in FIGS. 8 and 9, showing properties at three strength levels, i.e., T3 temper (as stretched), underaged (stretched and aged for 8 hours at 325° F.) and peak aged (stretched and aged for 24 hours at 325° F.

EXAMPLE VIII

For purposes of obtaining unrecrystallized thin gauge cold rolled sheet of heat treatable aluminum alloy, a 3.5 inch thick ingot containing 3.0 wt. % Cu, 2.0 wt. % Li and 0.11 wt. % Zr, the balance aluminum, was homogenized for 8 hours at 950° F. followed by 24 hours at 1000° F. and hot rolled to 0.25 inch thick sheet. Thereafter, the sheet was cold rolled to a gauge thickness of 0.1 inch sheet. This sheet was then reheated to 800° F. and hot rolled to 0.085 inch gauge to obtain an unrecrystallized product. The 0.85 inch sheet was solution heat treated at a temperature of 1000° F. for 0.5 hour and cold water quenched. X-ray analysis of this material even after solution heat treating showed that the material remained unrecrystallized. The results of this approach are illustrated in FIG. 11 which is an optical micrograph of solution heat treatment material in accordance with the invention. FIG. 10 shows conventionally treated material. That is, FIG. 10 shows cold rolled sheet which was solution heat treated. The X-ray analysis shows that the sheet was completely recrystallized.

EXAMPLE IX

An aluminum alloy consisting of, by weight, 1.97% Li, 2.83% Cu, 0.12% Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minures at 975° F. and hot rolled to 3.5 inch thick slab. The slab was reeeated for 4 hours at 1000° F. and hot rolled to 0.144 inch thick sheet. The sheet was, then annealed for 2 hours at 650° F. and cold rolled to 0.063 inch thick gauge sheet.

The cold rolled sheet (0.063 inch gauge) was solution heat treated for 30 minutes at 1020° F. followed by a cold water quench with a water temperature of 72° F. Examination of microstructure revealed heavily recrystallized microstructure with extremely coarse grain structures as shown in FIG. 10.

Figure 13:
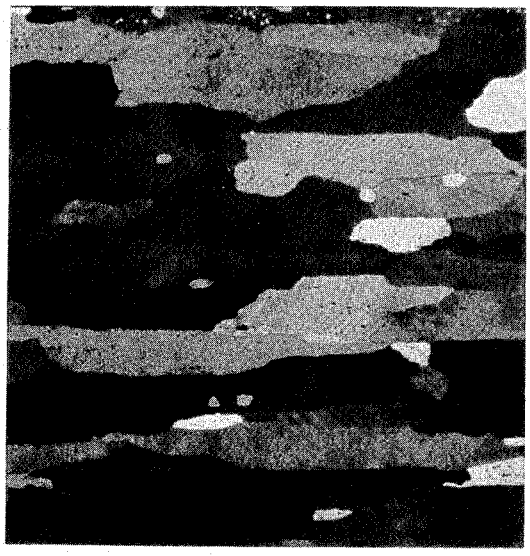
FIG. 13 shows an unrecrystallized metal structure of an aluminum-lithium alloy processed in accordance with the invention.

The 0.063 inch thick cold rolled sheet was heated to 800° F. then the temperature was slowly increased at a controlled heat-up rate to reach 850° F. in 8 hours, then soaked for 2 hours at 850° F., followed by a furnace cool to 72° F. The annealed sheet samples were then heat treated at 1020° F. for 30 minutes and cold water quenched. Microstructural examination by optical metallography revealed an unrecrystallized structure, shown as Ser. No. 585,703-1 in FIG. 13. The ramped anneal practice was found to be a more efficient anneal practice in preventing recrystallization than anneal practices utilizing a constant temperature.

EXAMPLE X

An aluminum alloy consisting of, by weight, 1.99% Li, 2.04% Cu, 1.48% Mg, 0.11% Zr, the balance being essentially aluminum and impurities, was cast into an ingot suitable for rolling. The ingot was homogenized in a furnace at a temperature of 970° F. for 8 hours followed immediately by a temperature of 900° F. for 24 hours and air cooled. The ingot was then preheated in a furnace for 30 minutes at 980° F., cooled to 890° F. and then hot rolled to 2.5 inch thick slab. The slab was reheated for 6 hours at 700° F. and for 2 hours at 750° F. and hot rolled to 0.180 inch thick sheet. The sheet was, then annealed for 4 hours at 650° F. and cold rolled to 0.100 inch thick gauge sheet.

Figure 14:
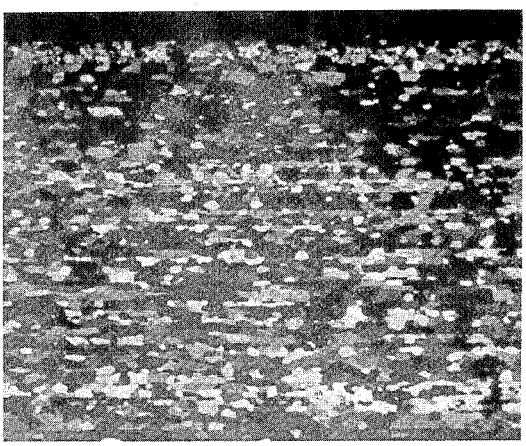
FIG. 14 shows a recrystallized metallurgical structure of an aluminum-lithium alloy.

The cold rolled sheet (0.100 inch gauge) was solution heat treated for 30 minutes at 1020° F. followed by a cold water quench with a water temperature of 72° F. Examination of microstructure revealed heavily recrystallized microstructure with extremely coarse grain structures as shown in FIG. 14.

Figure 15:
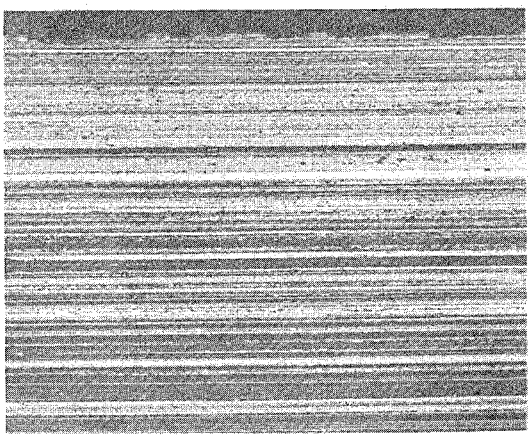
FIG. 15 shows an unrecrystallized metallurgical structure of an aluminum-lithium alloy.
Figure 16:
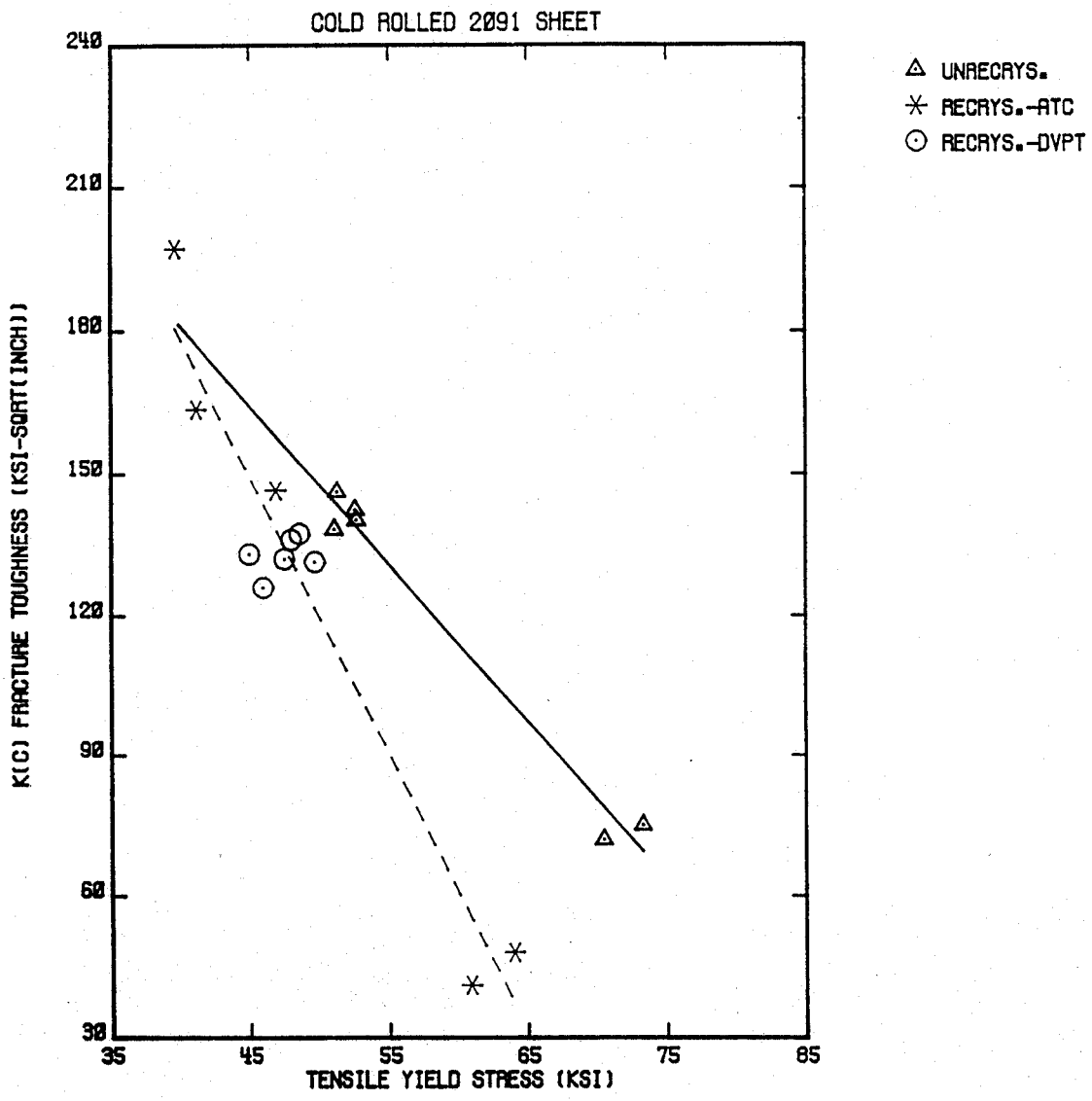
FIG. 16 is a graph showing the relationship of fracture toughness and tensile yield strength of AA2091 in the recrystallized and unrecrystallized condition.

The 0.100 inch thick cold rolled sheet was heated to 800° F. then the temperature was slowly increased at a controlled heat-up rate to reach 850° F. in 8 hours, then soaked for 2 hours at 850° F., followed by a furnace cool to 72° F. The annealed sheet samples were then heat treated at 980° F. for 30 minutes and cold water quenched. Microstructural examination by optical metallography revealed an unrecrystallized structure, as shown in FIG. 15. From FIG. 16, it will be seen that AA2091 treated in accordance with the invention is capable of providing higher fracture toughness values at higher tensile yield strengths, particularly above 48 KSI values, and the unrecrystallized material has a greater fracture toughness/tensile yield strength combination than recrystallized material.

While the invention has been described in terms of preferred embodiments, the claims appended hereto are intended to encompass other embodiments which fall within the spirit of the invention.

What is claimed is:

1. A method of producing an unrecrystallized wrought aluminum-lithium sheet product having improved levels of strength and fracture toughness, the method comprising the steps of:

(a) providing a body of a lithium containing aluminum base alloy consisting essentially of 1.5 to 2.5 wt. % Li, 1.6 to 2.8 wt. % Cu, 0.7 to 2.5 wt. % Mg, 0.03 to 0.20 wt. % Zr, 0.5 wt. % max. Fe, 5 wt. % max. Si, the balance essentially aluminum and incidental elements and impurities;

(b) heating the body to a hot working temperature;

(c) hot working the body to a first product:

(d) reheating said first wrought product while avoiding substantial recrystallization thereof, the reheating adapted to relieve stored energy capable of causing recrystallization during a subsequent heat treating step; and (e) solution heat treating, quenching and aging said reheated product to provide a substantially unrecrystallized product having improved levels of strength and fracture toughness.

2. The method in accordance withcclaim 1 wherein said first product is subjected to cold rolling to provide a second wrought product.

3. The method in accordance with claim 1 wherein hot rolling is performed starting at a temperature in the range of 700° to 950° F.

4. The method in accordance with claim 1 wherein the reheating is performed at an effective temperature of not lower than 750° F. and finished at a temperature of not greater than 920° F.

5. The method in accordance with claim 4 wherein the starting temperature is not lower than 750° F. and the finishing temperature is at least 50° to 150° higher than the starting temperature.

6. The method in accordance with claim 5 wherein the temperature is increased at a rate of 3° to 25° F. per hour.

7. The method in accordance with claim 5 wherein the temperature is increased at a rate of 5° to 15° F. per hour.

8. The method in accordance with claim 5 wherein said reheating includes soaking said product for at least one-half hour at the finishing temperature.

9. The method in accordance with claim 1 wherein said product contains 1.7 to 2.3 wt. % Li, 1.1 to 1.9 wt. % Mg, 1.8 to 2.5 wt. % Cu, 0.5 wt. % max. Fe, 0.5 wt. % max. Si, and 0 to 1.0 wt. % Zr the balance aluminum, incidental elements and impurities.

10. A method of producing an unrecrystallized wrought aluminum-lithium product having improved levels of strength and fracture toughness, the method comprising the steps of:

(a) providing a body of a lithium containing aluminum base alloy consisting essentially of 1.7 to 2.3 wt. % Li, 1.1 to 1.9 wt. % Mg, 1.8 to 2.5 wt. % Cu, 0.5 wt. % max. Fe, 0.5 wt. % max. Si, and 0 to 1.0 wt. % Zr, the balance aluminum, incidental elements and impurities;

(b) heating the body to a hot working temperature:

(c) hot working the body to a first product:

(d) cold working said first product to a second wrought product;

(e) reheating said second wrought product starting at a temperature of not lower than 750° F. and finishing at a temperature of at least 50° to 150° F. higher than the starting temperature, the increase in temperature being at the rate of 3° to 25° F. per hour, said reheating being performed while avoiding substantial recrystallization thereof, the reheating adapted to relieve stored energy capable of causing recrystallization during a subsequent heat treating step; and (f) solution heat treating, quenching and aging said reheated product to provide a substantially unrecrystallized product having improved levels of strength and fracture toughness.

11. The method in accordance with claim 10 wherein Zr is in the range of 0.04 to 0.16 wt. %.

12. The method in accordance with claim 10 wherein Zr is in the range of 0.1 to 0.15 wt. %.

13. The method in accordance with claim 1 wherein after said hot working step, said first product is subjected to a second heating step and then subjected to a second hot rolling step to form a second product.

14. The method in accordance with claim 13 wherein said second heating step is carried out at a temperature in the range of 650° to 850° F.

15. The method in accordance with claim 14 wherein said second heating step is carried out a a temperature in the range of 700° to 800° F.

16. The method in accordance with claim 13 wherein said heating step is carried out for a period in the range of 0.5 to 20 hours.

17. The method in accordance with claim 13 wherein said heating step is carried out for a period in the range of 0.5 to 8 hours.

18. The method in accordance with claim 13 wherein after said second hot rolling step, said second product is subjected to an anneal at a temperature in the range of 500° to 850° F.

19. The method in accordance with claim 10 wherein after reheating to said higher temperature, said second product is soaked for at least one-half hour.

20. An unrecrystallized aluminum base alloy sheet product having improved levels of strength and fracture toughness in response to a reheating treatment, the product consisting essentially of 1.5 to 2.5 wt. % Li, 0.7 to 2.5 wt. % Mg, 1.6 to 2.8 wt. % Cu, 0.5 wt. % max. Fe, 0.5 wt. % max. Si, and 0 to 1.0 wt. % Zr, the balance substantially aluminum, incidental elements and impurities, the product having improved levels of strength and fracture toughness resulting from reheating said product to a temperature below recrystallization prior to solution heat treating, the reheating for a time and temperature effective in relieving stored energy capable of causing recrystallization during solution heat treating.

21. The product in accordance with claim 20 wherein said reheating treatment is perforeed at an effective temperature of not lower than 750° F. and finishes at a temperature of not greater than 920° F.

22. The product in accordance with claim 20 wherein the effective temperature is not lower than 750° F. and the finishing temperature is at least 50° to 150° higher than the effective temperature.

23. The product in accordance with claim 22 wherein the temperature is increased at a rate of 3° to 25° F. per hour.

24. The product in accordance with claim 22 wherein the temperature is increased at a rate of 5° to 15° F. per hour.

25. The product in accordance with claim 22 wherein said reheating includes soaking said product for at least one-half hour at the finishing temperature.

26. The product in accordance with claim 20 wherein Li is in the range of 1.7 to 2.3 wt. % and Zr is in the range of 0.03 to 0.15 wt. %.

27. The product in accordance with claim 20 wherein Cu is in the range of 1.8 to 2.5 wt. %.

28. The product in accordance with claim 20 wherein Mg is in the range of 1.1 to 1.9 wt. %.

29. The product in accordance with claim 20 wherein Zr is in the range of 0.09 to 0.15 wt. %.

30. An unrecrystallized aluminum base alloy sheet product having improved levels of strength and fracture toughness in response to a reheating, the product consisting essentially of 1.7 to 2.3 wt. % Li, 1.1 to 1.9 wt. % Mg, 1.8 to 2.5 wt. % Cu, 0.03 to 0.2 wt. % Zr, 0.5 wt. % max. Fe, 0.5 wt. % max. Si, the balance substantially aluminum, incidental elements and impurities, the product having improved levels of strength and fracture toughness resulting from reheating said produc to a temperature below recrystallization prior to solution heat treating, the reheating being to a temperature less than 920° F. and for a time effective in relieving stored energy capable of causing recrystallization during solution heat treating.

31. An unrecrystallized aluminum base alloy sheet product having improvdd levels of strength and fracture toughness, the alloy consisting essentially of 1.5 to 2.5 wt. % Li, 0.7 to 2.5 wt. % Mg, 1.6 to 2.8 wt. % Cu, 0.04 to 0.16 wt. % Zr, the balance substantially aluminum, incidental elements and impurities.

32. An unrecrystallized aluminum base alloy sheet product having improved levels of strength and fracture toughness, the alloy cosisting essentially of 1.7 to 2.3 wt. % Li, 1.1 to 1.9 wt. % Mg, 1.8 to 2.5 wt. % Cu, 0.04 to 0.16 wt. % Zr, the balance substantially aluminum, incidental elements and impurities.

33. The sheet product in accordance with claim 32 wherein a cladding of aluminum or aluminum alloy is applied to at least one side thereof.

* * * * *